US007900782B2

(12) United States Patent
Goserud et al.

(10) Patent No.: US 7,900,782 B2
(45) Date of Patent: Mar. 8, 2011

(54) APPARATUS FOR THE STORAGE OF STEMWARE

(76) Inventors: Elisa Goserud, Jackson Center, PA (US); Noreen Herlihy, Jackson Center, PA (US)

( * ) Notice: Subject to any disclaimer, the term of this patent is extended or adjusted under 35 U.S.C. 154(b) by 76 days.

(21) Appl. No.: 12/315,982

(22) Filed: Dec. 10, 2008

(65) Prior Publication Data

US 2010/0140198 A1 Jun. 10, 2010

(51) Int. Cl.
*A47G 29/00* (2006.01)

(52) U.S. Cl. ..... 211/85.29; 211/183

(58) Field of Classification Search ..... 211/85.29, 211/126.15, 75, 74, 40, 134, 189, 76, 41.1, 211/113, 13.1, 181.1, 41.11, 46, 59.2, 183, 211/71.01, 117; D6/513–515; D32/55, 58; D7/704

See application file for complete search history.

(56) References Cited

U.S. PATENT DOCUMENTS

| | | | | | |
|---|---|---|---|---|---|
| 956,501 | A * | 4/1910 | Oichman | 223/91 |
| 1,925,540 | A * | 9/1933 | Neuschotz | 248/313 |
| 3,022,899 | A * | 2/1962 | Unsworth | 211/41.2 |
| 3,154,196 | A * | 10/1964 | Loska, Jr. et al. | 211/41.2 |
| 3,214,031 | A * | 10/1965 | McCauley | 211/41.2 |
| 4,228,905 | A * | 10/1980 | Cammarota | 211/41.2 |
| 4,589,556 | A * | 5/1986 | Peretz | 211/41.9 |
| 4,748,993 | A * | 6/1988 | Llewellyn | 134/166 R |
| 4,836,392 | A * | 6/1989 | Constantino | 211/133.5 |
| D307,990 | S * | 5/1990 | Funk | D6/513 |
| D308,924 | S * | 7/1990 | VanNoord | D6/513 |
| D347,129 | S * | 5/1994 | Zinke et al. | D6/468 |
| 6,354,455 | B1 * | 3/2002 | Chen | 220/489 |
| 6,843,381 | B2 * | 1/2005 | Wu | 211/85.29 |
| 7,131,545 | B1 * | 11/2006 | Grogan | 211/85.29 |
| 2006/0113263 | A1 * | 6/2006 | Kratochvil | 211/85.29 |
| 2009/0184075 | A1 * | 7/2009 | McCormick | 211/85.7 |
| 2009/0255888 | A1 * | 10/2009 | Melvin | 211/85.29 |

* cited by examiner

*Primary Examiner* — Darnell M Jayne
*Assistant Examiner* — Devin Barnett
(74) *Attorney, Agent, or Firm* — Norman B. Rainer

(57) ABSTRACT

An apparatus for slidably storing stemware in an inverted position employs horizontally elongated front and rear track members held by spaced apart support members and an overhead anchoring member, and interactive to receive stemware in a direction orthogonal to the direction of elongation of the track members.

3 Claims, 4 Drawing Sheets

APPARATUS FOR THE STORAGE OF STEMWARE

BACKGROUND OF THE INVENTION

1. Field of the Invention

This invention relates to the handling of stemware, and more particularly concerns apparatus for the easy storage and retrieval of a number of stemware items.

2. Description of the Prior Art

Stemware consists of a vessel of glass or crystal used primarily for beverages and desserts and having a rounded bowl mounted upon a footed stem. The bowl is generally of very fragile, thin-walled construction susceptible to breakage. The foot portion is generally of circular contour, having a diameter often smaller than the diameter of the bowl. The stem portion, vertically emergent from the foot portion, is usually integral with the bowl and foot portions, causing the stemware to be of monolithic construction. The stem portion usually has a length of 3 to 5 inches, thereby producing a high center of gravity with a consequent propensity of the stemware to tip over.

Systems for the storage of stemware have been disclosed in U.S. Pat. Nos. 3,022,899; 3,214,031; 4,228,905; 4,589,556; and elsewhere. Said storage systems usually employ a rack having paired horizontally elongated rails which support the stemware in an inverted position by slidable engagement with the base portions of the stemware. The rails are usually mounted to an overhead support. Although such manner of storage is reasonably protective, it requires that the stemware be entered onto a front access extremity of the rack, and pushed back toward a closed rear extremity.

In commercial bars, restaurants and other establishments where large numbers of stemware are handled, the removal of an item of stemware from the front extremity of an elongated rack becomes troublesome when, for example the rack holds about 20 items within a 70 inch rack length. Specifically, the last stemware, adjacent the closed rear extremity of the rack must be slid 70 inches for removal.

In residential kitchens, the cabinetry generally has a depth of about 12 inches and a horizontal length of 3-4 feet. If a stemware-holding rack were to be suspended from an overlying shelf in the typical kitchen cabinet, and structured to have a front access extremity, the rack could accommodate at most 4 stemware items. If the stemware-holding rack were alternatively oriented in the length direction of the cabinet, the open and closed extremities of the rack would be difficult to reach because of close proximity to end walls of the cabinet and interference with other contents of the cabinet.

It is accordingly an object of the present invention to provide apparatus for the inverted storage of stemware in a manner which facilitates entrance of stemware onto said apparatus and the removal of stemware therefrom.

It is another object of this invention to provide apparatus of the aforesaid nature comprising an elongated rack extending between supported opposed extremities which are closed with respect to passage of stemware.

It is a further object of the present invention to provide apparatus of the aforesaid nature of durable construction and amenable to low cost manufacture and installation.

These objects and other objects and advantages of the invention will be apparent from the following description.

SUMMARY OF THE INVENTION

The above and other beneficial objects and advantages are accomplished in accordance with the present invention by a stemware holding apparatus comprising:

a) horizontally spaced apart paired support members, b) an anchoring member horizontally elongated between opposed ends which engage said support members, c) a rear track member positioned below said anchoring member in parallel relationship therewith, and elongated between first and second opposed ends which engage said support members, d) at least one front track member positioned below said anchoring member, having a shorter length than said rear track member and substantially coplanar therewith, said front track member extending between a proximal extremity which engages a support member, and a distal extremity, and e) a holding post downwardly directed from said anchoring member to securement with the distal extremity of said front track member.

A portion of said rear track member may be provided with a rearwardly recessed configuration which produces a transition zone that facilitates sliding entry and release of stemware, said recessed portion spanning said holding post.

In a preferred embodiment, the stemware holding apparatus of this invention is incorporated into a wooden rung ladder. The side rails of the ladder function as the requisite horizontally spaced apart paired support members, and each rung of the ladder serves as the necessary horizontally elongated anchoring member. In such embodiment, several vertically spaced units of the stemware holding apparatus can be provided within a relatively small footprint area.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
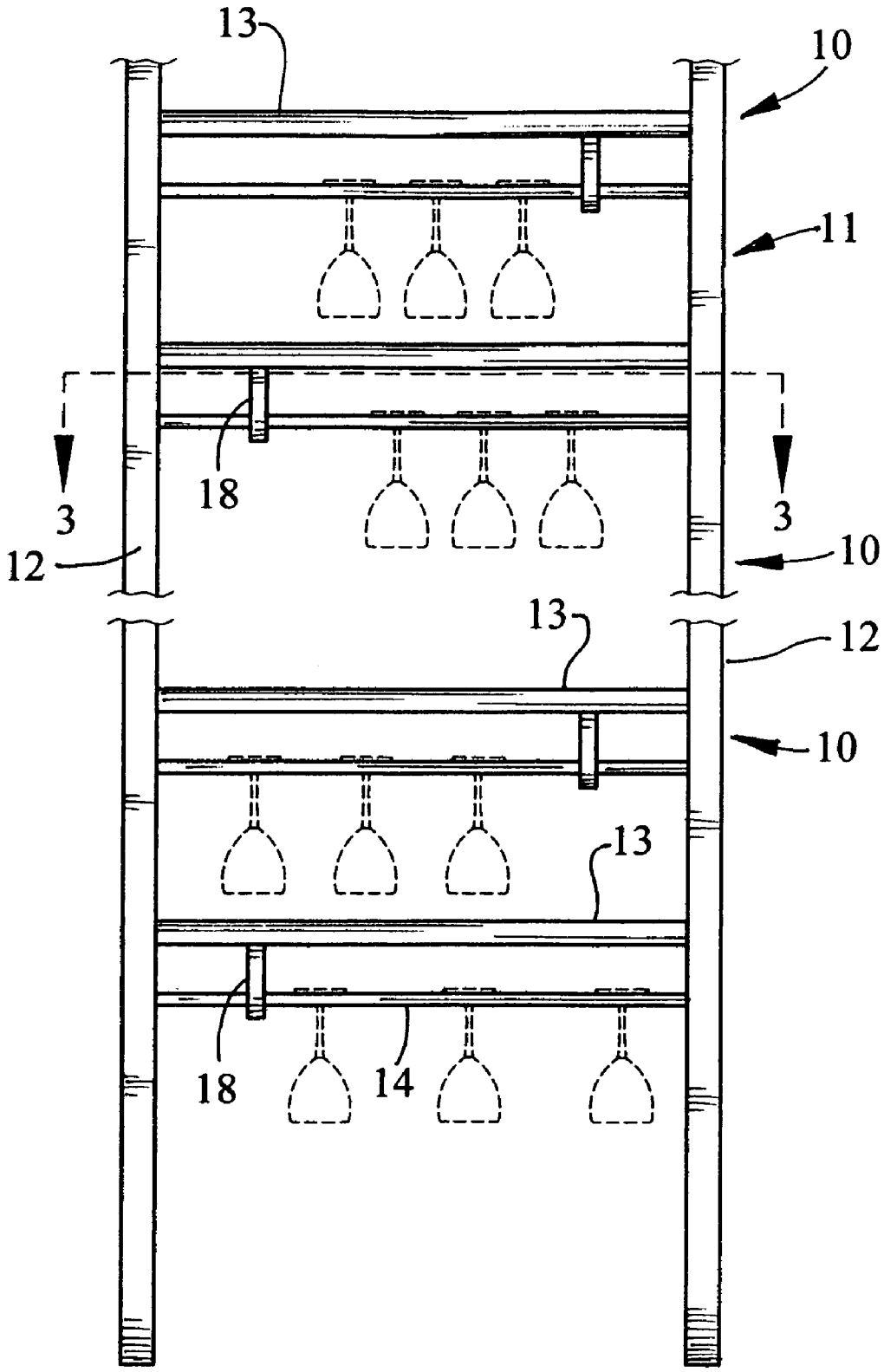
FIG. 1 is a front view of a first embodiment of the stemware holder of this invention, a plurality of which are incorporated into a wooden rung ladder shown with portions broken away, and showing stemware, not a part of this invention, illustrated in phantom outline.
Figure 2:
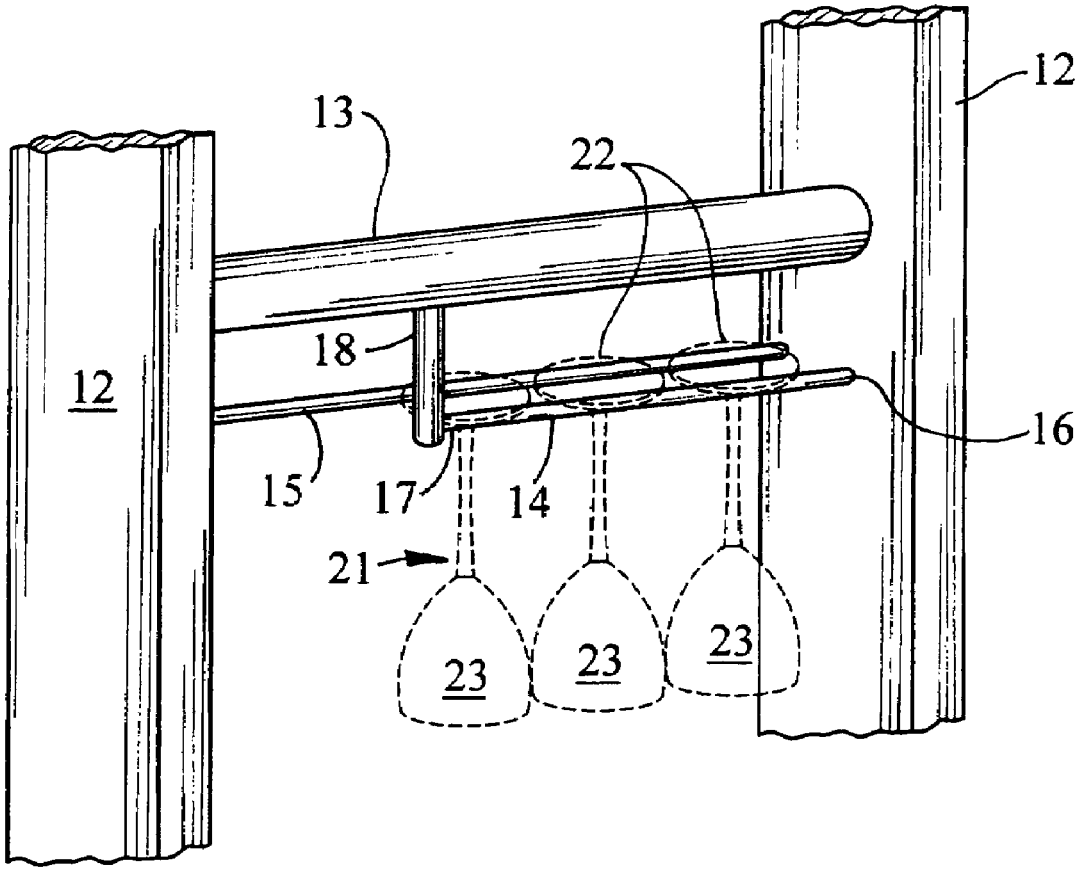
FIG. 2 is a fragmentary front perspective view of the embodiment of FIG. 1.

Referring now to FIGS. 1-4, several units 10 of a first embodiment of the stemware holder of this invention are shown incorporated into a wooden rung ladder 11 comprised of paired parallel side rails 12 and a series of vertically spaced apart rungs 13 extending between rails 12.

Each of the several units of the stemware holder is comprised of a rung of the ladder, and front and rear track members 14 and 15, respectively, positioned beneath the associated rung in substantially coplanar horizontal juxtaposition. Each rung functions as an anchoring member, and said side rails function as horizontally spaced apart paired support members.

Front track member 14 is of shorter length than the associated rear track member, and extends between a proximal extremity 16 which engages a side rail, and a distal extremity 17 supported by a holding post 18 downwardly directed from the associated rung 13.

Figure 3:
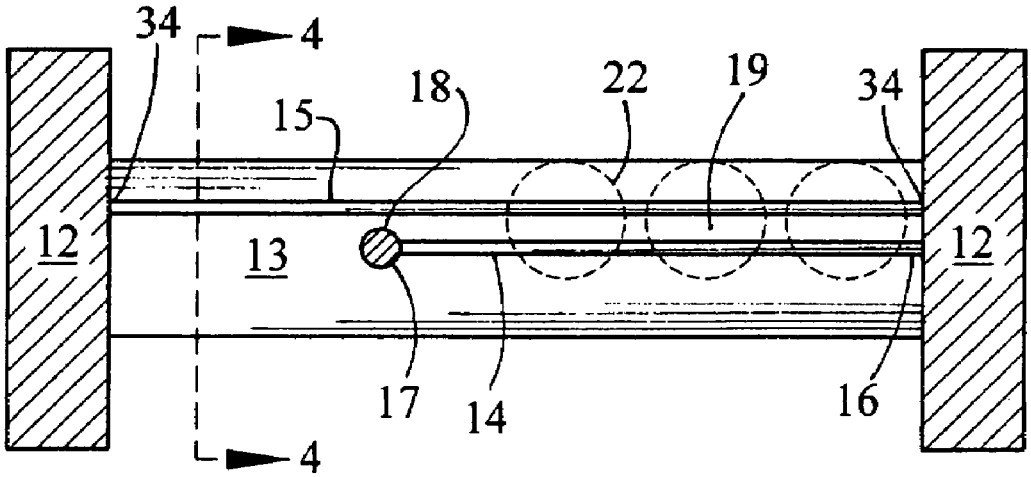
FIG. 3 is an enlarged horizontal sectional view taken in the direction of the arrows upon line 3-3 of FIG. 1.
Figure 4:
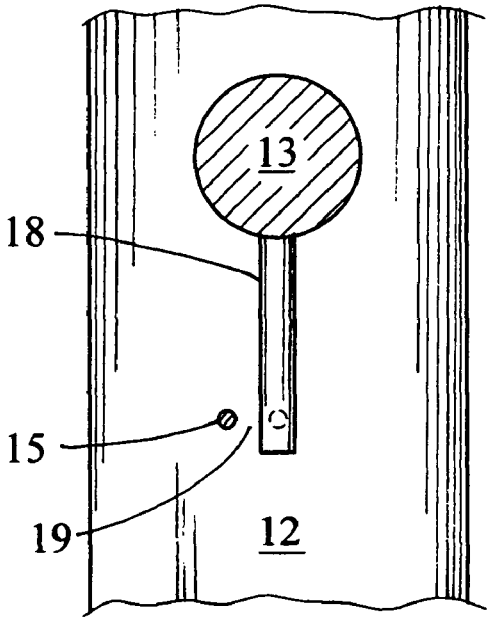
FIG. 4 is an enlarged vertical sectional view taken in the direction of the arrows upon the line 4-4 of FIG. 3.

As best shown in FIG. 3, rear track member 15 extends between opposed ends 34 which engage side rails 12, and is configured to provide in conjunction with said front track member a stemware retaining region 19 bounded by parallel lengths of said tracks spaced apart by a distance of 1-2 inches. Stemware 21 is entered onto retaining region 19 by holding the stemware upside down and at an angle to permit passage of the circular base portions 22 of the stemware to pass holding post 18.

Figure 6:
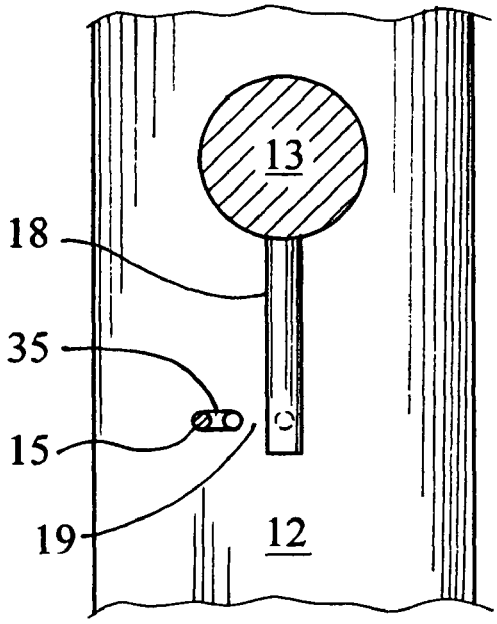
FIG. 6 is a vertical sectional view taken in the direction of the arrows upon the line 6-6 of FIG. 5.
Figure 5:
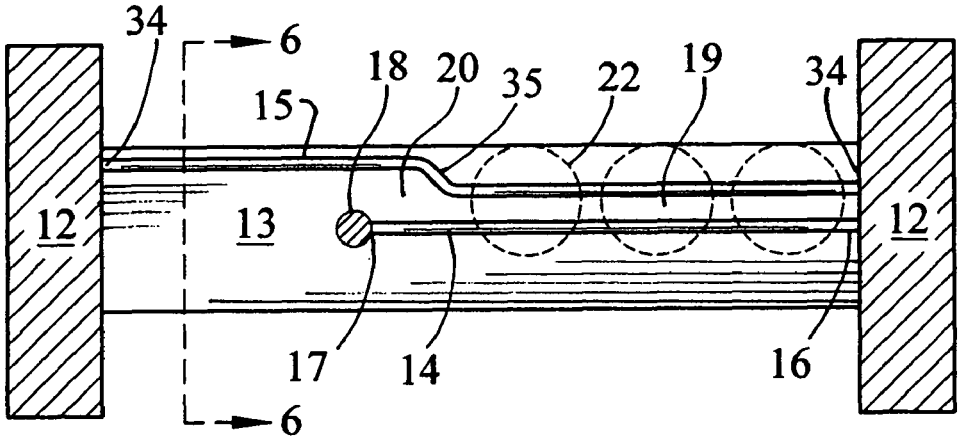
FIG. 5 is a horizontal sectional view of a second embodiment of the stemware holder of this invention.

In a second embodiment, illustrated in FIGS. 5 and 6, a portion of rear track member 15 is rearwardly displaced by virtue of dogleg 35 to produce a transition zone 20 spanning post 18 to permit upright entrance and removal of the stemware. Such configuration enables the stemware 21 to be retained in inverted position, suspended by their circular base portions 22, with bowl portions downwardly directed. The dimensional configuration of the transition zone, in conjunction with the placement of post 18, further prevents inadvertent release of the stemware. Such function is achieved because the base portion of the stemware is caused to abut against post 18 upon sliding removal, thereby necessitating a change in the removal path.

The incorporation of several units of the first embodiment of the stemware holding apparatus into a rung ladder is of further interest as a combination of ornamental value which may match the decor of a kitchen, living room, office, recreation room or bar.

Figure 7:
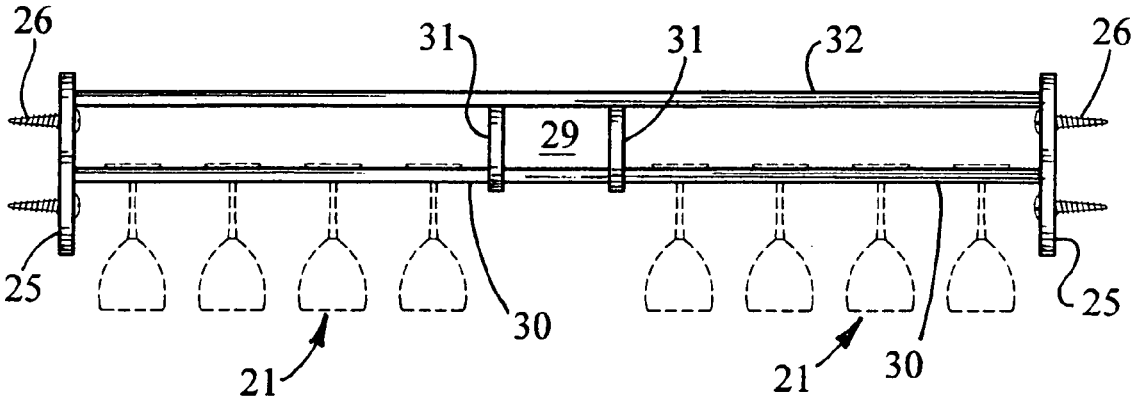
FIG. 7 is a front view of a third embodiment of the stemware holder of the present invention.
Figure 8:
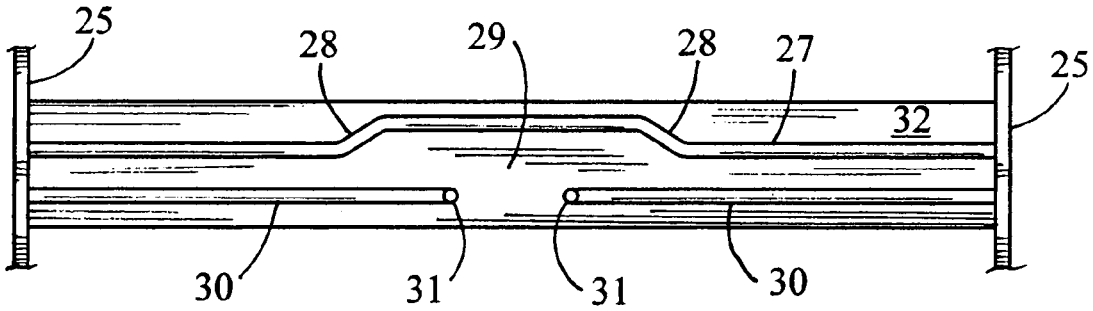
FIG. 8 is a bottom view of the stemware holder of FIG. 7.

The third embodiment of the stemware holding apparatus of this invention, shown in FIGS. 7 and 8, is adapted to fit within a conventional kitchen cabinet. Horizontally spaced apart paired support members, in the form of flat panels 25 are adapted to be joined to the existing side walls of the cabinet by threaded screws 26. Rear track 27 extends the entire distance between flat panels 25, and has a rearwardly recessed portion, produced by paired dog legs 28 that forms a bi-directional transition zone 29. Two separate, oppositely opposed front tracks 30 are employed in linear alignment, each supported by vertical posts 31 downwardly directed from an overhead anchoring member in the form of wooden plank 32 secured by panels 25. In this embodiment, stemware can be entered into and removed from the holding apparatus in a path orthogonal to the direction of elongation of the apparatus at the easily accessible central location of transition zone 29. The stemware can be slidably moved in either direction, providing a holding capacity considerably greater than a single unit of the first embodiment described hereinabove. Also, despite its larger holding capacity, the stemware need not have to be slid excessive distances for storage or retrieval. In further variations, the end panels 25 of said second embodiment of the apparatus may be provided with telescopically adjustable length means to facilitate lateral accommodation to fit into kitchen cabinets, bookcases or closets of varied lateral length.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. Apparatus for holding several stemware items having a circular base connected by a stem to a bowl portion, said apparatus comprising a rung ladder having a plurality of vertically spaced rungs:

horizontally spaced apart paired parallel side rails, said rungs horizontally elongated between opposed ends which engage said side rails, a rear track member positioned below each of said rungs in parallel relationship therewith, said rear track member being elongated between first and second opposed ends which engage said side rails, a front track member positioned below each of said rungs, having a shorter length than said rear track member and substantially coplanar therewith, said front track member extending between a proximal extremity which engages one of said side rails, and a distal extremity, and defining in conjunction with said rear track member a retaining region which slidably holds said stemware items in inverted position, and a holding post downwardly directed from each of said rungs to securement with the distal extremity of said front track member and positioned to impede passage of said stemware items by abutment with the base portions thereof.

2. The apparatus of claim 1 wherein said ladder is of wooden construction.

3. Apparatus for holding several stemware items having a circular base connected by a stem to a bowl portion, said apparatus comprising:

horizontally spaced apart paired support members; an anchoring member horizontally elongated between opposed ends which engage said support members; a rear track member positioned below said anchoring member in parallel relationship therewith, and elongated between first and second opposed ends which engage said support members; a front track member positioned below said anchoring member, having a shorter length than said rear track member and substantially coplanar therewith, said front track member extending between a proximal extremity which engages a support member, and a distal extremity, and defining in conjunction with said rear track member a retaining region adapted to slidably hold said stemware items in inverted position; a holding post downwardly directed from said anchoring member to securement with the distal extremity of said front track member and positioned to impede passage of said stemware items by abutment with the base portions thereof; wherein said stemware is entered into said retaining region by holding the stemware upside down and at an angle to permit passage of the circular base portions of the stemware to pass said holding post.

* * * * *